US005941216A

United States Patent [19]

Arakawa

[11] Patent Number: 5,941,216

[45] Date of Patent: Aug. 24, 1999

[54] METHOD FOR CONTROLLING DRIVE OF INJECTOR FOR INTERNAL COMBUSTION ENGINE AND APPARATUS THEREFOR

[75] Inventor: Yoshinobu Arakawa, Numazu, Japan

[73] Assignee: Kokusan Denki Co., Ltd., Shizuoka-ken, Japan

[21] Appl. No.: 08/977,332

[22] Filed: Nov. 24, 1997

[51] Int. Cl.[6] ..... F02M 51/00

[52] U.S. Cl. ..... 123/490; 361/154

[58] Field of Search ..... 123/490; 361/154

[56] References Cited

U.S. PATENT DOCUMENTS

| | | | |
|---|---|---|---|
| 5,452,700 | 9/1995 | Matsuura | 123/490 |
| 5,515,830 | 5/1996 | Arakowa | 123/490 |
| 5,558,065 | 9/1996 | Arakawa | 123/490 |

FOREIGN PATENT DOCUMENTS

| | | |
|---|---|---|
| 1259 | 1/1983 | Japan . |
| 287850 | 10/1992 | Japan . |

*Primary Examiner*—John Kwon

*Attorney, Agent, or Firm*—Pearne, Gordon, McCoy & Granger LLP

[57] ABSTRACT

A method for controlling drive of an injector for an internal combustion engine which is capable of reducing a minimum injection quantity available for the control to increase a dynamic range of the injector is disclosed. A voltage across a solenoid coil is stepwise increased when a drive pulse is generated, so that a current fed to the solenoid coil is increased to a level higher than that of the drive current at the time when an injection valve starts port opening operation. Then, the drive current is gradually reduced toward a hold value required to hold the injection valve at a port opening position at a time-based variation ratio less than that of the drive current at the time when the voltage across the solenoid coil is stepwise decreased from a peak value, so that the voltage is stepwise reduced at the time when the drive pulse is extinguished, resulting in the drive current being extinguished.

6 Claims, 6 Drawing Sheets

Idp
Idh
0
t0
t3
ΔT
t6
ΔT
Time t[sec]

Vd
0
t0
t3
t4
t6
Time t[sec]
T0
TD6

Open
Close
t0
t1
t2
t6
t7
Time t[sec]
TD3
(TD3=(t4-t3)+TD4)

Open
Close
t0
t1
t2
t5
Time t[sec]
TD4

Open
Close
t0
t1
t2
t3
t4
t5
Time t[sec]

METHOD FOR CONTROLLING DRIVE OF INJECTOR FOR INTERNAL COMBUSTION ENGINE AND APPARATUS THEREFOR

BACKGROUND OF THE INVENTION

This invention relates to a method for controlling drive of an injector for an internal combustion engine and an apparatus therefor.

In general, an injector has been conventionally used for the purpose of feeding an internal combustion engine with fuel, which includes a cylinder provided at a distal end thereof with a fuel injection port, an injection valve for operating or selectively opening the injection port and a solenoid coil fed with a drive current when the injection valve opens the fuel injection port. Fuel is fed into the cylinder from a fuel tank under a pressure of a predetermined level by means of a fuel pump.

The injector is so arranged that the fuel injection port communicates with both an intake manifold of the internal combustion engine and a fuel injection space defined in a cylinder of the engine which is a space defined in the cylinder into which fuel is to be injected. The injector thus arranged functions to permit the injection valve to open the fuel injection port, resulting in injection of fuel when a drive current of a predetermined level is fed to the solenoid coil.

A fuel injection rate or a rate at which fuel is injected from the injector is generally determined depending on a pressure under which fuel is fed from the fuel pump and a period of time for which the fuel injection port is kept open by the injection valve. In general, a pressure of fuel fed to the injector is controlled to be constant by means of a pressure regulator, so that a rate of fuel injected from the injector depends on a period of time during which the injection valve keeps the fuel injection port open.

A unit for driving the thus-constructed injector generally includes a drive current detection circuit for detecting a drive current flowing through the solenoid coil to generate a drive current detection signal, an indication signal generation circuit for generating an indication signal providing an indicated value for the drive current, and a current feed control circuit for controlling current feed to the solenoid coil so as to render the drive current equal to the indicated value. The current feed control circuit permits a drive current corresponding in magnitude to the indication signal to be flowed through the solenoid coil during a period of time for which it is fed with a drive pulse like a rectangular wave for commanding injection of fuel while using the drive current detection signal and indication signal as an input therefor.

In order to improve characteristics for controlling a rate at which fuel is fed to an internal combustion engine by means of the injector, it is desired to increase a dynamic range of the injector as much as possible, to thereby increase a width of adjustment of the fuel injection rate. The dynamic range used herein indicates a ratio (qmax/qmin) between a maximum fuel injection rate (qmax) and a minimum one (qmin).

In the art, a saturated system and a peak hold system have been known as a method for driving the injector constructed as described above.

The saturated system is adapted to connect a switch element such as a transistor or the like in series to the solenoid coil to provide the switch element with a drive pulse like a rectangular wave while setting a resistance value of a current feed circuit of the solenoid coil at a relatively high level as much as about 12 Ω. The switch element is kept turned on while it is fed with the drive pulse, resulting in applying a power voltage of a constant level to the solenoid coil. Such application of the power voltage to the solenoid coil gradually increases the drive current flowing through the solenoid coil, to thereby render the injection valve open when the drive current reaches a valve opening current level. Then, the drive current converges to a saturated value determined depending on both an impedance of the current feed circuit and the power voltage and is kept at the saturated value until the drive pulse is extinguished. Such extinction of the drive pulse causes the drive current to be rendered zero.

The saturated system thus constructed simplifies construction of the drive circuit, leading to a reduction in manufacturing cost of the drive control unit; however, it causes the drive current to be kept at the saturated value for a relatively long period of time, to thereby cause an increase in power consumption, resulting in an increase in generation of heat therefrom.

In the injector of the electromagnetic type which is adapted to drive the injection valve by means of the solenoid, it is required to flow a relatively large current as high as a valve opening current value or more through the solenoid coil when the injection valve opens the fuel injection port. The valve opening current value is an inherent or intrinsic value determined depending on the injector. However, when it is desired that the fuel injection port is subsequently kept open once it is opened, it is merely required to flow a hold current of a level lower than the valve opening current value therethrough. Thus, the peak hold system, as disclosed in Japanese Patent Publication No. 1259/1983 and Japanese Patent Application Laid-Open Publication No. 287850/1992, is so constructed that the drive current is rapidly increased to a peak value above the valve opening current value when the drive pulse is applied to the solenoid coil and then reduced to a hold value required to hold the fuel injection port open, to thereby hold it at the hold value until the drive pulse is extinguished, while setting a resistance value of the solenoid coil at a level as low as about 2 Ω.

Thus, the peak hold system permits the drive current to be reduced to the hold value after opening of the fuel injection port, leading to a reduction in power consumption, resulting in heat generation being minimized. Also, it decreases a port opening period or a period of time during which the fuel injection port is kept open, so that the maximum fuel injection rate or quantity when a cycle of generation of the drive pulse is rendered constant may be increased. Thus, the peak hold system increases a dynamic range of the injector as compared with the saturated system.

Conventionally, driving of the injector according to the peak hold system is carried out in a manner to apply a fixed drive voltage stepwise rising to the solenoid coil to increase a drive current flowing through the solenoid coil toward a peak value, stepwise reduce a drive voltage to a low level to attenuate the drive current to the hold value after the drive current reaches the peak value, and then decrease the drive voltage to a zero level to naturally attenuate the drive current to a zero level when the drive pulse is extinguished.

In the case that the drive voltage is varied as described above, the injection valve starts operation of opening fuel injection port (hereinafter also referred to "port opening operation") when a predetermined length of port opening time elapses after application of the drive pulse, so that the injection valve opens the fuel injection port at certain time. When the drive voltage is reduced to a zero level at the time when the drive pulse is extinguished, the drive current is naturally attenuated, resulting in being reduced to a zero level in a short period of time. Irrespective of such a reduction of the drive current to a zero level, the fuel injection port is kept open for a certain period of time due to a residual magnetic flux of the solenoid coil, so that the injection valve starts operation of closing the fuel injection port (hereinafter also referred to as "port closing operation") when a predetermined period of lag time elapses after the drive voltage is reduced to a zero level.

Control of a fuel feed rate or a rate at which fuel is fed to the internal combustion engine by means of the injector is carried out by varying a pulse width of the drive pulse to vary a port opening period of the injection valve, to thereby vary the fuel injection rate. In this instance, in order to improve the control characteristics, it is desired to increase a dynamic range of the injector as much as possible, to thereby increase an adjustment width of the fuel injection rate.

Unfortunately, techniques wherein a voltage across the solenoid coil is stepwise decreased to naturally attenuate the drive current to the hold value when the drive current is shifted from the peak value to the hold value as in the prior art reduces a pulse width of the drive pulse due to a decrease in fuel injection rate, resulting in the port closing operation of the injection valve being started at identical time irrespective of a length of the pulse width of the drive pulse (or irrespective of time at which the drive pulse is rendered zero) when the drive pulse is rendered zero during shift of the drive current from the peak value to the hold value. This fails to permit a fuel injection quantity per one drive pulse to be varied in correspondence to a variation in pulse width of the drive pulse. Such a failure in variation in fuel injection rate or quantity in correspondence to a variation in pulse width of the drive pulse leads to a failure in control of the fuel injection rate, so that control of the fuel feed rate based on a variation in pulse width of the drive pulse requires to restrict a lower limit value of the pulse width of the drive pulse in order to avoid such a situation as described above. Thus, employment of the conventional drive procedure in control of the injector according to the peak hold system causes an increase in minimum injection rate available for the control, leading to a decrease in dynamic range of the injector, resulting in a reduction in adjustment range of the fuel injection rate during control of the fuel injection rate, so that the control characteristics for the fuel injection rate are deteriorated.

SUMMARY OF THE INVENTION

The present invention has been made in view of the foregoing disadvantage of the prior art.

Accordingly, it is an object of the present invention to provide a method for controlling drive of an injector for an internal combustion engine which is capable of significantly reducing a minimum fuel injection rate available for the control to increase a dynamic range of the injector.

It is another object of the present invention to provide an apparatus for executing the above-described drive control method.

The present invention is directed to a method for controlling, in response to a drive pulse for commanding injection of fuel, an injector for an internal combustion engine including an injection valve for operating a fuel injection port and a solenoid coil fed with a drive current during port opening operation of the injection valve, as well as a drive control apparatus for executing the method.

In accordance with one aspect of the present invention, a method for controlling drive of an injector for an internal combustion engine. The drive control method includes the step of stepwise increasing a voltage across the solenoid coil to increase the drive current flowing through the solenoid coil to a peak value set to be higher than a level of the drive current at which the injection valve starts port opening operation when the drive pulse is generated and gradually reducing the drive current toward a hold value required to hold the injection valve at a position at which the fuel injection port is rendered open (hereinafter also referred to as "port opening position") at a time-based variation ratio thereof less than a time-based variation ratio of the drive current at the time when the voltage across the solenoid coil is stepwise reduced from the peak value. Also, the method includes the step of stepwise reducing the voltage across the solenoid coil to extinguish the drive current at the time when the drive pulse is extinguished.

The prior art, as described above, causes a situation that a variation in fuel injection quantity per one drive pulse is failed in spite of an increase in pulse width of the drive pulse, when the pulse width of the drive pulse is reduced to render the drive pulse zero during shift of the drive current from the peak value to the hold value. Thus, the prior art causes an increase in minimum fuel injection rate or quantity available for the control, to thereby reduce a dynamic range of the injector, resulting in failing in satisfactory control of a fuel injection rate.

On the contrary, the present invention, as described above, is so constructed that the control is carried out in a manner to render a time-based variation ratio of the drive current during shift of the drive current from the peak value to the hold value less than that of the drive current at the time when a voltage across the solenoid coil is stepwise reduced, to thereby slowly vary the drive current from the peak value to the hold value, resulting in the drive current converging to the hold value. Such construction permits time at which port opening operation of the injection valve is started to be necessarily varied in correspondence to a variation in time of rising of the drive pulse, resulting in time at which the injection valve closes the fuel injection port being delayed with delay of rising time of the drive pulse, even when the drive pulse is rendered zero at any time in the course of shift of the drive current from the peak value to the hold value. Therefore, the fuel injection rate or quantity is necessarily increased with an increase in pulse width of the drive pulse.

Thus, the present invention effectively exhibits control characteristics which permit the fuel injection rate to be necessarily increased with an increase in pulse width of the drive pulse, to thereby reduce the minimum fuel injection rate or quantity available for the control. This results in a dynamic range of the injector being increased, leading to an improvement in control of the fuel injection rate.

In accordance with another aspect of the present invention, an apparatus for controlling drive of an injector for an internal combustion engine wherein the injector includes an injection valve for selectively closing a fuel injection port and a solenoid coil fed with a drive current when the injection valve opens the fuel injection port. The apparatus includes a drive current detection circuit for detecting the drive current of the injector to generate a drive current detection signal, an indication signal generation circuit for generating an indication signal providing an indicated value for the drive current, and a current feed control circuit for controlling current feed to the solenoid coil so as to permit a drive current corresponding in magnitude to the indication signal to flow through the solenoid coil during a period of time for which a drive pulse for commanding fuel injection is generated while using the drive current detection signal and indication signal as an input therefor. The indication signal generation circuit is so constructed that a signal having a waveform which rises to a first level when the drive pulse is generated and then gradually falls at a time-based variation rate less than a time-based variation time of the drive current at the time when a voltage across the solenoid coil is stepwise reduced, to thereby ultimately converge to a second level is generated as the indication signal. The first level of the indication signal is set so as to have a magnitude corresponding to a peak value of the drive current which is set to be higher than a level of the drive current at the time when the injection valve starts port opening operation. The second level of the indication signal is set at a magnitude corresponding to a hold value of the drive current required to hold the injection valve at a port opening position.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENTS

Now, the present invention will be detailedly described hereinafter with reference to the accompanying drawings.

Figure 6A:
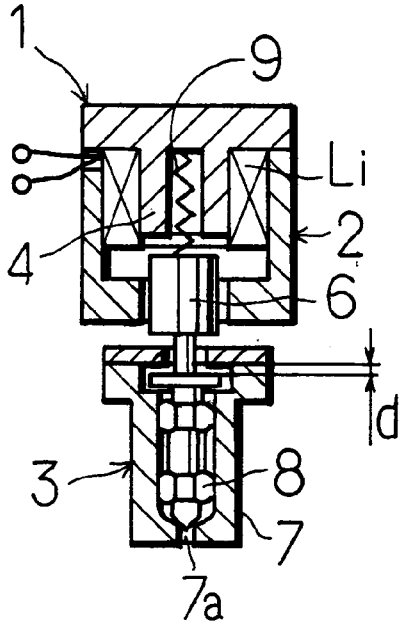
FIG. 6A is a sectional view showing an example of an injector kept closed which is subject to control of the present invention.
Figure 6B:
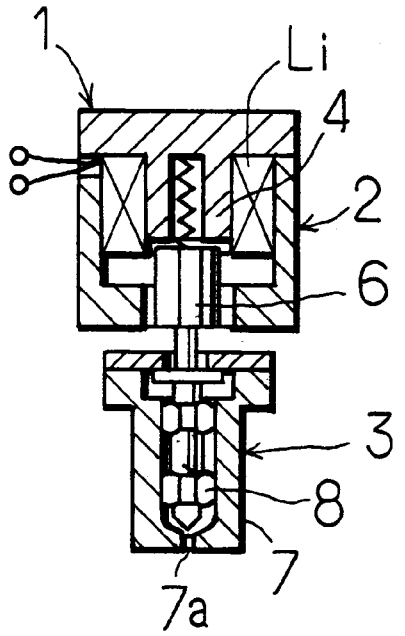
FIG. 6B is a sectional view showing the injector of FIG. 6A which is kept open.

An injector or electromagnetic fuel injection valve for feeding fuel to an internal combustion engine may include, for example, a solenoid or electromagnet 2 and an injection nozzles as shown in FIGS. 6A and 6B. The solenoid 2 includes a fixed core 4, a solenoid coil Li wound on the fixed core 4 and a movable core 6 and is constructed so as to permit the fixed core 4 to attract the movable core 6 when the solenoid coil Li is fed with a drive current.

The injection nozzle 3 includes a cylinder 7 formed at a distal end thereof with a fuel injection port 7*a* and an injection valve or needle valve 8 inserted into the cylinder 7 to operate or selectively close the fuel injection part 7*a* and connected to the movable core 6. The movable core 6 is urged in a direction of permitting the injection valve 8 to close the fuel injection port 7*a* by means of a return spring 9.

In FIG. 6A, the injector is kept from being fed with the drive current, wherein the injection valve 8 is kept at a position at which the fuel injection port is rendered closes (hereinafter referred to as "port closing position") to close the fuel injection port 7*a*; whereas in FIG. 6B, the injector is kept fed with the drive current, wherein the fixed core 4 attracts the movable core 6 to the hold the injection valve 8 at a port opening position or a position at which the injection port is rendered open. The injection nozzle 3 is fed with fuel under a pressure of a predetermined level from a fuel pump, so that the fuel is injected from the injection port 7*a* when the injection valve 8 is shifted to the port opening position. In FIG. 6A, reference character d designates a stroke of the injection valve 8. When such a fuel injection valve is incorporated in the injector, a fuel injection rate is determined depending on a pressure of fuel fed to the injection nozzle 3 and a period of time for which the valve is kept open.

When the injector thus constructed is driven according to a peak hold system, a resistance value of the solenoid coil Li is set to be as low as about 2 Ω; so that when a drive pulse for commanding injection of fuel is fed to the injector, the drive current is rapidly increased to a peak value higher than a valve opening current value and then reduced to a hold value required for holding the valve open, so that the hold value is held until the drive pulse is extinguished.

In order to facilitate understanding of the present invention, operation of the injector will be described hereinafter with reference to a procedure wherein a voltage across the solenoid coil is stepwise decreased to naturally attenuate the drive current to the hold value during shift of the drive current from the peak value to the hold value.

Figures 7A, 7B, 7C, 7D, 7E:
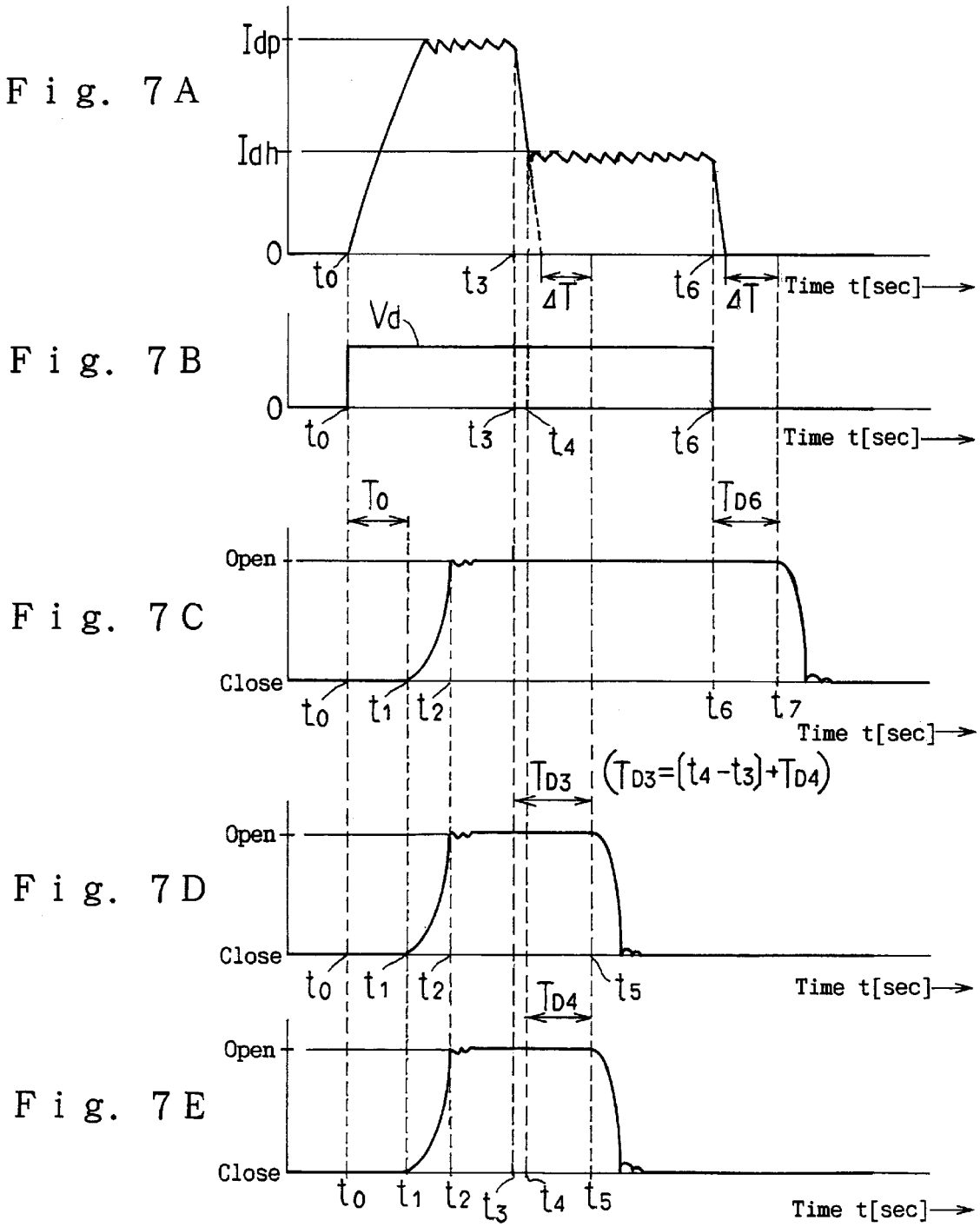
FIGS. 7A to 7E are waveform diagrams showing a waveform of a drive current, a waveform of a drive pulse and behavior of an injection valve each obtained when a voltage across a solenoid coil is stepwise decreased to naturally attenuate a drive current of an injector to a hold value during shift of the drive current from a peak value to the hold value.

FIG. 7 shows a waveform of each of the drive current and drive pulse and behavior of the injection valve 8 obtained when the injector is driven in such a manner as described above, by way of example. In FIG. 7, a drive voltage of a constant level which stepwise rises is applied to the solenoid coil when a drive pulse Vd shown in (B) of FIG. 7 is provided at time t0, so that a drive current Id is increased toward a peak value Idp. The drive current Id is subject to chopper control, to thereby be kept at the peak value for a predetermined period of time and then the drive voltage is stepwise reduced at time t3. Such a reduction in drive voltage permits the drive current Id to be naturally attenuated. Also, the drive current is subject to chopper control for holding the drive current at a hold value Idh during a period of time after time t4 at which the drive current reaches the hold value, so that the hold value is held till time t6 at which the drive pulse Vd is extinguished. When the drive pulse is extinguished at the time t6, the drive voltage of the solenoid coil is reduced to a zero level, to thereby naturally attenuate the drive current, resulting in the drive current being extinguished. Behavior of the injection obtained when the drive voltage of the solenoid coil is reduced to a zero level at the time t6 at which the drive pulse is extinguished is as shown in (C) of FIG. 7, wherein the needle valve or injection valve starts to shift toward the port opening position at time t1 at which a predetermined period of time for which the fuel injection port is kept open (hereinafter also referred to "port opening period") T0 elapses from the time t0 and is increased in an amount of lift to a maximum level at time t2, resulting in the fuel injection port being rendered open. When the drive voltage is rendered zero at the time t6, the drive current is caused to naturally attenuate, to thereby be reduced to a zero level in a short period of time. Even when the drive current is reduced to zero, the injection valve is held at the port opening position for a period of time ΔT by a residual magnetic flux of the solenoid; so that the injection valve starts port closing operation at time t7 at which a predetermined time lag TD6 elapses from the time t6 at which the drive voltage is rendered zero.

When the fuel injection rate is to be controlled, a pulse width of the drive pulse Vd is varied so as to have a magnitude corresponding to a desired value of the fuel injection rate. When the pulse width of the drive pulse is reduced in order to decrease the fuel injection rate, resulting in the drive pulse Vd being rendered zero at the time t3 in FIG. 7, behavior of the injection valve is as shown in (D) of FIG. 7. In this instance, the drive voltage of the solenoid coil is rendered zero at the time t3, so that the drive current Id is attenuated along an attenuation curve indicated at solid lines and broken lines in (A) of FIG. 7 from the time t3, to thereby be rendered zero. However, even when the drive current is thus rendered zero, the residual magnetic flux permits the injection valve to be kept at the port opening position during the period ΔT; so that the closing operation of the injection valve is started at the time t5 at which the time lag TD3 elapses from the time t3 at which the drive pulse is rendered zero.

Also, in FIG. 7, supposing that the drive pulse Vd is rendered zero at the time t4, the injection valve exhibits such a behavior as shown in (E) of FIG. 7. In this instance, the drive current is caused to attenuate to a zero level along the completely same broken attenuation curve as in the drive pulse at the time t3. The residual magnetic flux holds the fuel injection port open for the period ΔT in spite of the drive current being zero, so that the port opening operation of the injection valve is started at time at which a predetermined period of time TD4 elapses from the time t4 at which the drive pulse is rendered zero. When either the drive pulse is rendered zero at the time t3 or the drive pulse is rendered zero at the time t4, the drive current is attenuated according the same attenuation curve; so that time at which the injection-valve starts the port closing operation when the drive pulse is rendered zero at the time t4 is the same as time t5 at which the port closing operation of the injection valve is started when the drive pulse is rendered zero at the time t3. A time lag TD3 in the port closing operation of the injection valve when the drive pulse is rendered zero at the time t3 and the time lag TD4 in the closing operation of the injection valve when the drive pulse is rendered zero at the time t4 establish relationship TD3=(t4−t3)+TD4 therebetween.

As described above, the port closing operation of the injection port is started at the same time T5 both in the case that the drive pulse Vd is rendered zero at the time t3 and in the case that the drive pulse is rendered zero at the time t4, so that a period of time during which the fuel injection port is kept open or the injection valve is kept at the port opening position when the pulse width of the drive pulse is set to be t3−t0 and that when it is set to be t4−t0 are equal to each other, resulting in the fuel injection rate being kept unvaried or constant.

Figure 8:
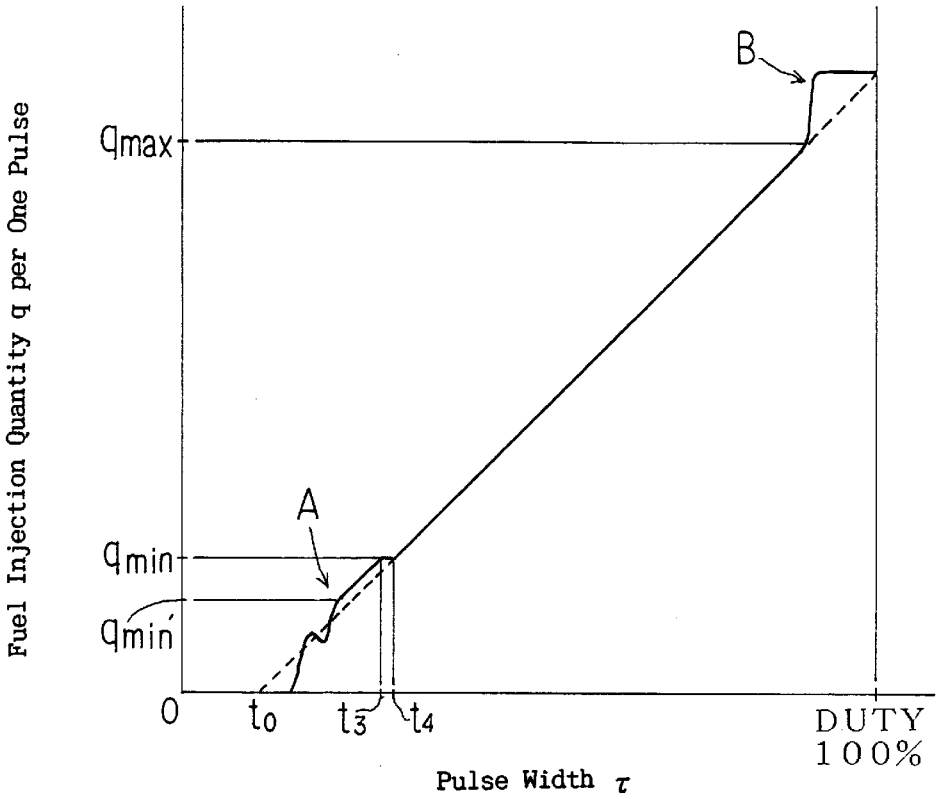
FIG. 8 is a graphical representation showing an example of relationship between a fuel injection rate of an injector and a pulse width of a drive pulse which is obtained when a drive pulse for commanding fuel injection is fed thereto.

Driving of the injector in such a manner as shown in FIG. 7 permits such relationship as shown in FIG. 8 to be established between a pulse width τ of the drive pulse and a fuel injection quantity q per one drive pulse. The pulse width τ indicated by the axis of abscissas in FIG. 8 is expressed by a duty ratio (pulse width/one cycle) of the drive pulse.

Figure 9:
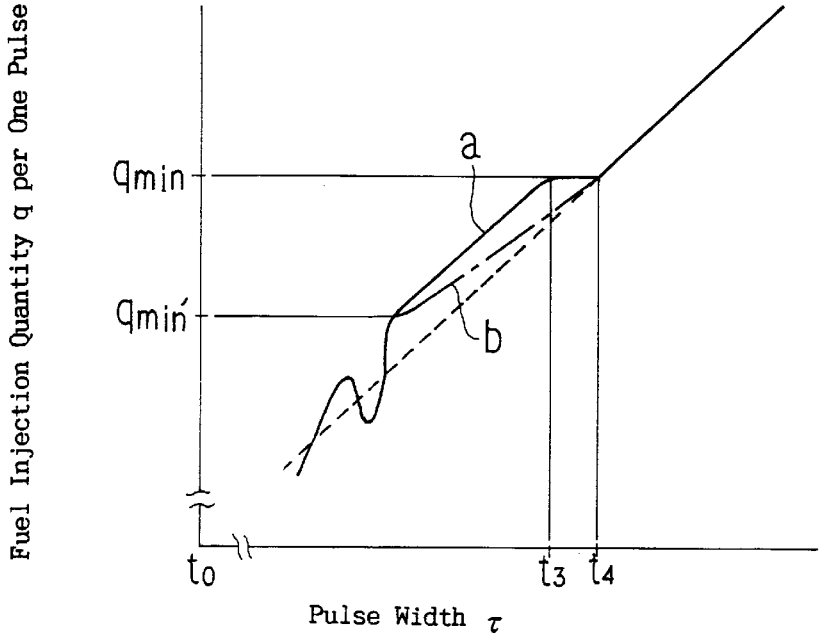
FIG. 9 is a graphical representation enlargedly showing a part indicated at A in FIG. 8.

Characteristics shown in FIG. 8 cause a variation in fuel injection quantity with respect to a variation in pulse width of the drive pulse to be nonlinear in a range of a part A. Characteristics near the part A in FIG. 8 are enlargedly indicated by a curve a in FIG. 9. More particularly, a variation in pulse width does not lead to a variation in fuel injection quantity q in a section in which the pulse width is increased from t3−t0 to t4−t0. Even when the relationship between the pulse width and the fuel injection quantity is nonlinear, a portion or range of the relationship which permits an increase in pulse width to lead to an increase in fuel injection quantity is available for control of the injector, however, a portion or range thereof in which a variation in pulse width of the drive pulse does not lead to a variation in fuel injection quantity is not available for the control at all. Thus, when such relationship as shown in FIG. 8 is established between the pulse width of the drive pulse and the fuel injection quantity, the range of the portion A in FIG. 8 is not available for the control. In this instance, it is required to set the pulse width of the drive pulse within a range of t4−t0 or more, wherein a minimum injection quantity available for control of the injector is indicated by qmin in FIGS. 8 and 9.

Also, when the pulse width of the drive pulse approaches 100%, the next drive pulse is ready to be fed to the injection valve before the fuel injection port is closed or the fuel injection valve is moved to the port closing position, leading to a situation that a variation in pulse width τ of the drive pulse causes no variation in fuel injection quantity. Thus, in this instance, a maximum fuel injection quantity available for the control is indicated by qmax in FIG. 8. , As described above, when the procedure wherein a voltage across the solenoid coil is stepwise reduced to naturally attenuate the drive current of the injector to the hold level while the drive current for the injector is shifted from the peak value to the hold value is employed, a range in which an increase in pulse width fails to permit an increase in fuel injection quantity occurs, resulting in the minimum fuel injection quantity qmin available for control of the injector being relatively increased to reduce a dynamic range of the injector, leading to a deterioration in characteristics of the injector for controlling the fuel injection rate on the basis of the pulse width of the drive pulse.

The present invention is to solve the above-described problem. The drive control method of the present invention is constructed so as to stepwise increase a voltage across a solenoid coil to increase a drive current flowing through the solenoid coil to a peak value set to be higher than a level at which an injection valve starts port opening operation when a drive pulse is generated, gradually reduce the drive current toward a hold value required to holding the injection valve at a port opening position at a time-based variation ratio less than that of the drive current occurring when the voltage across the solenoid coil is stepwise reduced from the peak value, and then stepwise reduce the voltage across the solenoid coil to extinguish the drive current when the drive pulse is extinguished.

Figure 1:
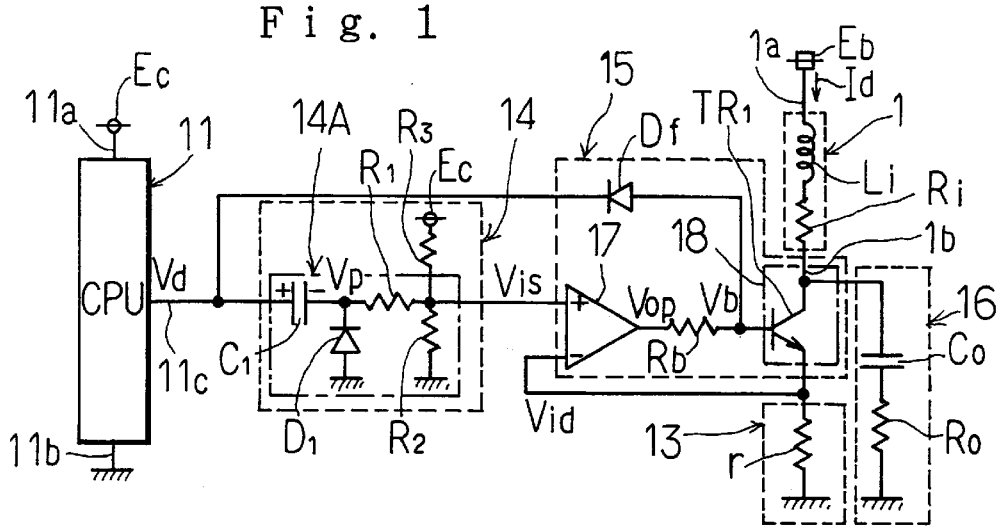
FIG. 1 is a circuit diagram showing an example of a drive control apparatus suitable for execution of a drive control method according to the present invention.
Figure 2A:
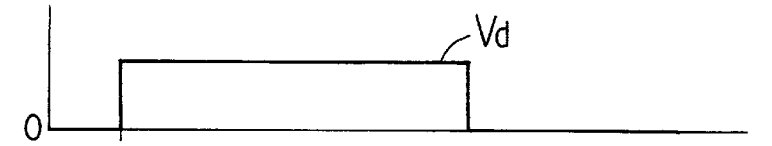
FIGS. 2A to 2F are waveform diagrams showing a signal waveform at each of various parts of the apparatus of FIG. 1.
Figure 2B:
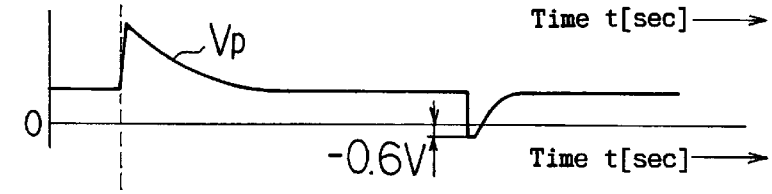
Figure 2C:
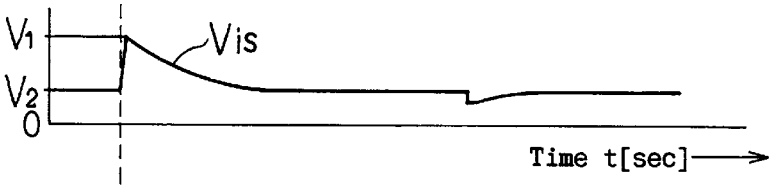
Figure 2D:
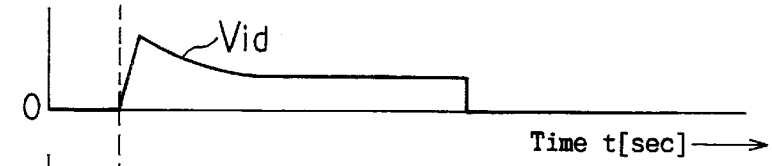
Figure 2E:
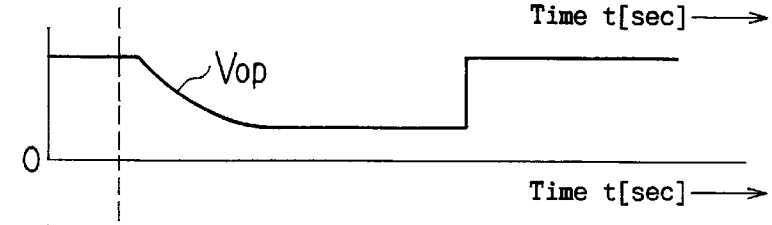
Figure 2F:
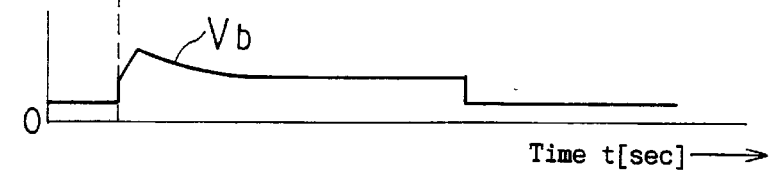

Referring now to FIG. 1, an apparatus suitable for use for executing the method of the present invention is illustrated. In FIG. 1, reference numeral 11 designates a microcomputer (CPU). The microcomputer 11 includes a power terminal 11*a*, a grounded output terminal 11*b* and a non-grounded terminal 11*c* and realizes a drive pulse generation means adapted to execute a predetermined program to generate a drive pulse Vd. The power terminal 11*a* of the CPU 11 is connected to an output terminal on a positive polarity side of a control power circuit (not shown) or a positive-side output terminal thereof for generating a control DC voltage Ec and the grounded output terminal 11*b* of the CPU 11 is connected to a negative-side output terminal of the control power circuit. The output terminal 11*c* of the CPU 11 is adapted to output the drive pulse Vd therefrom and has a potential increased to a high level when the drive pulse Vd is generated and held at a ground level when the drive pulse Vd is not generated. The drive pulse Vd may have such a waveform as shown in, for example, (A) of FIG. 2.

An injector generally designated by reference numeral 1 includes a fuel injection valve for openably operating or selectively closing a fuel injection port and a solenoid coil Li fed with a drive current when the injection valve opens the fuel injection port, wherein the injection valve opens the fuel injection port to permit injection of fuel when a drive current Id of a predetermined level or more is flowed through the solenoid coil Li. Ri indicates a resistor of a current feed circuit for feeding the drive current to the solenoid coil Li.

Reference numeral 13 designates a drive current detection circuit for detecting the drive current Id of the injector 1 to generate a drive current detection signal Vid, 14 is an indication signal generation circuit for generating an indication signal Vis providing an indicated value for the drive current, and 15 is a current feed control circuit for controlling current feed to the solenoid coil so as to permit a drive current corresponding in magnitude to the indication signal Vis to be flowed through the solenoid coil of the injector 1 during a period of time for which the drive pulse Vd is provided while using the drive current detection signal Vid and indication signal Vis as an input therefor.

The injector 1 is connected at one input terminal 1*a* thereof to a positive-side output terminal of a DC power supply (not shown) for generating a drive voltage Eb and at the other input terminal 1*b* to a collector of an NPN transistor TR1. The transistor TR1 also has an emitter connected to a ground potential section through a current detection resistor r substantially reduced in resistance value. The resistor r constitutes the drive current detection circuit 13 described above. Between the collector of the transistor TR1 and the ground is connected a protective circuit 16 constituted by a series circuit constructed of a capacitor Co and a resistor Ro. The protective circuit 16 is provided for the purpose of absorbing a high voltage induced across the solenoid coil Li of the injector 1, to thereby protect the injector itself and the transistor TR1 from the high voltage when the transistor TR1 is turned off and absorbing a high-frequency noise. However, when a high voltage induced across the injector may not possibly lead to damage to the injector 1 and transistor TR1 and the high-frequency noise does not matter, the protective circuit may be deleted.

The transistor TR1 has a base connected through a control signal output resistor Rb to an output terminal of an operational amplifier 17, which is fed at an inverting input terminal thereof and a non-inverting input terminal thereof with the drive current detection signal Vid and indication signal Vis, respectively.

In the illustrated embodiment, the transistor TR1 constitutes a drive current feed amplifier 18 which functions to feed the solenoid coil Li with the drive current Id proportional to a control signal Vb comprising a signal outputted from the transistor TR1 through the resistor Rb.

Between the base of the transistor TR1 or a control signal input terminal of the amplifier 18 and the output terminal 11*c* of the CPU 11 or a non-grounded output terminal of a drive pulse generation means is connected a feedback diode Df while facing the output terminal 11*c* of the CPU 11. The feedback diode Df functions to hold the control signal Vb at a low level below an input threshold level of the drive current feed amplifier 18 when the drive pulse Vd is not generated or when the output terminal 11*c* of the CPU 11 is at a ground potential.

In the illustrated embodiment, the current feed control circuit 15 is constituted by cooperation of the operational amplifier 17 to which the indication signal Vis and drive current detection signal Vid are respectively inputted through the non-inverting input terminal and inverting input terminal thereof, the control signal output resistor Rb, the drive current feed amplifier 18 for feeding the solenoid coil Li with the drive current proportional to the control signal Vb comprising the signal outputted from the operational amplifier 17 through the control signal output resistor Rb, and the feedback diode Df connected between the control signal input terminal of the amplifier 18 and the non-grounded output terminal 11*c* of the drive pulse generation means or CPU 11 to hold the control signal Vb at the low level below the input threshold level of the drive current feed amplifier when the drive pulse Vd is not generated or when the output terminal 11*c* of the CPU 11 is at the ground potential.

The indication signal generation circuit 14 includes a differentiation capacitor C1 having one end connected to the non-grounded output terminal of the CPU or drive pulse generation means 11, a first resistor R1 of which one end is connected to the other end of the differentiation capacitor C1, a second resistor R2 connected between the first resistor R1 and the ground, a differentiation circuit 14A including a diode D1 connected between the other end of the differentiation capacitor C1 and the ground while keeping an anode thereof facing the ground, and a third resistor R3 connected between the positive-side output terminal of the control power circuit generating the control DC voltage Ec, wherein the second resistor R2 is connected at a non-grounded terminal thereof or an indication signal output terminal thereof to the non-inverting input terminal of the operational amplifier 17.

The differentiation circuit 14A is constructed so as to differentiate rising of the drive pulse Vd to generate such a differentiation pulse Vp as shown in (B) of FIG. 2 across a series circuit of the first resistor R1 and second resistor R2. When the output terminal 11*c* of the CPU 11 is kept at a ground potential to extinguish the drive pulse Vd, charges in the capacitor C1 are instantaneously discharged through the output terminal 11*c* of the CPU 11, the ground circuit and the diode D1, so that the differentiation pulse Vp instantaneously falls as shown in (B) of FIG. 2. At this time, the differentiation pulse Vp is varied toward a negative side by an amount (about 0.6 V) corresponding to a voltage drop in a forward direction of the diode D1.

Also, in the indication signal generation circuit 14, a voltage dividing circuit is constructed of the third resistor R3 and second resistor R2, so that a signal formed by superposing a base voltage or a voltage corresponding to that obtained by subjecting the control DC voltage Ec (for example, 5 V) to voltage dividing by means of the voltage dividing circuit and an output signal of the differentiation circuit 14A on each other appears at both ends of the second resistor R2. Thus, across the second resistor R2 is generated the indication signal Vis having a waveform which substantially instantaneously rises to a first level V1 and then gradually falls to converge to a second level V2, as shown in (C) of FIG. 2. In the illustrated embodiment, the resistor R2 and resistor R3 cooperate with each other to provide a base voltage superposition circuit for superposing a base voltage of a predetermined level on an output of the differentiation circuit 14A.

In the present invention, the drive pulse Vd may have a level set so that the first level V1 of the indication signal Vis is rendered equal to a magnitude corresponding to a peak value Idp of the drive current Id set to be higher than a level of the drive current at the time when the injection valve starts port opening operation.

Further, the differentiation circuit 14A has a constant (a capacitance of the capacitor C1, a resistance value of each of the resistors R1 and R2) set so as to ensure that a time-based variation ratio of the indication signal Vis at the time when the indication signal Vis falls from the first level V1 toward the second level V2 is substantially less than a time-based variation ratio of the drive current at the time when a voltage across the solenoid coil Li is stepwise decreased (a variation ratio of the drive current during a period from time t3 to time t4 in FIG. 7).

In addition, the second and third resistors R2 and R3 each have a resistance value set so that the second level V2 of the indication signal Vis has a magnitude corresponding to a hold value Idh of the drive current required to hold the injection valve at a port opening position.

In the injector drive control apparatus shown in FIG. 1, when the drive current is kept from flowing through the solenoid coil, resulting in the drive current detection signal being rendered zero, an output voltage Vop of the operational amplifier 17 is permitted to be at a high level. In this instance, when the drive pulse Vd is not generated, a potential at the output terminal 11*c* of the CPU 11 is rendered zero; so that a potential at the base of the transistor R1 or the control signal input terminal of the amplifier 18 is kept below the input threshold level of the transistor TR1, resulting in the transistor TR1 being kept turned off. Thus, when the drive pulse Vd is kept from being generated, the drive current Id of the injector 2 is rendered zero. When the CPU 1 generates the drive pulse Vd, the indication signal generation circuit 14 generates such an indication signal Vis as shown in (C) of FIG. 2. At this time, a level of the control signal Vb fed from the operational amplifier 17 to the base of the transistor TR1 is permitted to be equal to the input threshold level of the transistor or more, so that a resistance of the collector-emitter circuit of the transistor is decreased, to thereby permit the drive current ID to flow to the injector 2. The drive current Id is increased following an increase in level of the indication signal Vis and reaches a peak at time slightly delayed from time at which a level of the indication signal Vis reaches a peak. Then, the drive current Id is decreased with a decrease in level of the indication signal Vis. A level of the drive current detection signal Vid, as shown in (D) of FIG. 2, is varied with a variation in drive current Id. When the drive pulse Vd is extinguished, a potential at the base of the transistor TR1 is reduced below the threshold level thereof through the diode Df and the ground circuit of the CPU 11, so that the transistor TR1 is turned off, resulting in the drive current Id being rendered zero.

(D) of FIG. 2 shows that the drive current detection signal Vid is immediately rendered zero when the transistor TR1 is turned off. However, when the protective circuit 16 is incorporated in such a manner as shown in FIG. 1, a current is permitted to flow through the protective circuit 16 even after turning-off of the transistor TR1, so that the drive current detection signal Vid is permitted to have a waveform which attenuates in a predetermined period of time after turning-off of the transistor TR1.

Figure 3A:
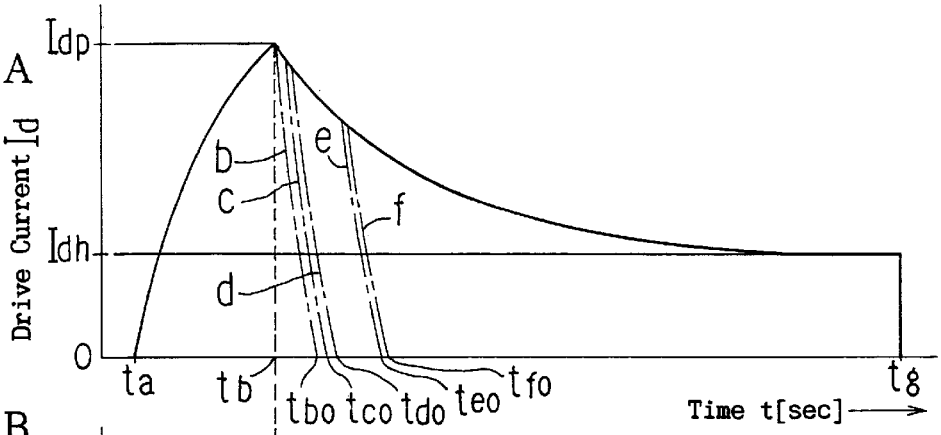
FIGS. 3A and 3B are waveform diagrams showing an example of a waveform of a drive current flowing through a solenoid coil of an injector when a drive control method of the present invention is executed, as well as an example of a waveform of a drive pulse.
Figure 3B:
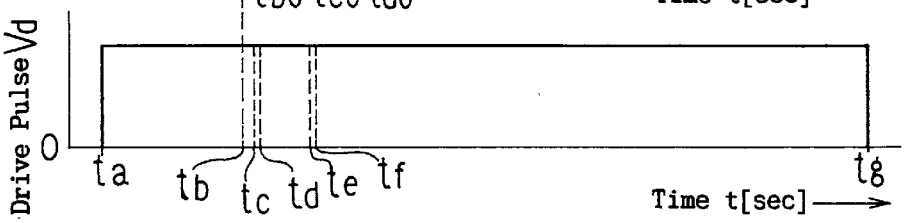
Figure 5A:
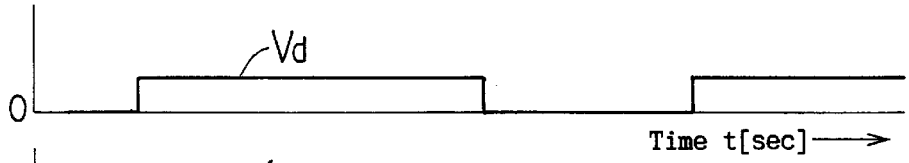
FIGS. 5A to 5D are waveform diagrams showing a signal waveform at each of various parts of the apparatus of FIG. 4.
Figure 5B:
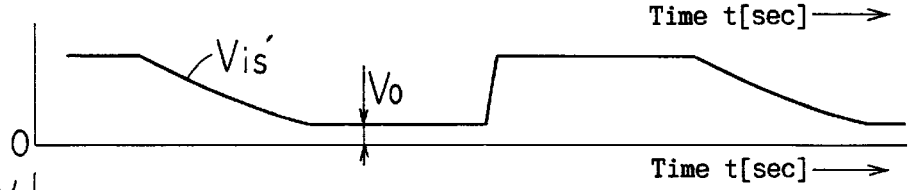
Figure 5C:
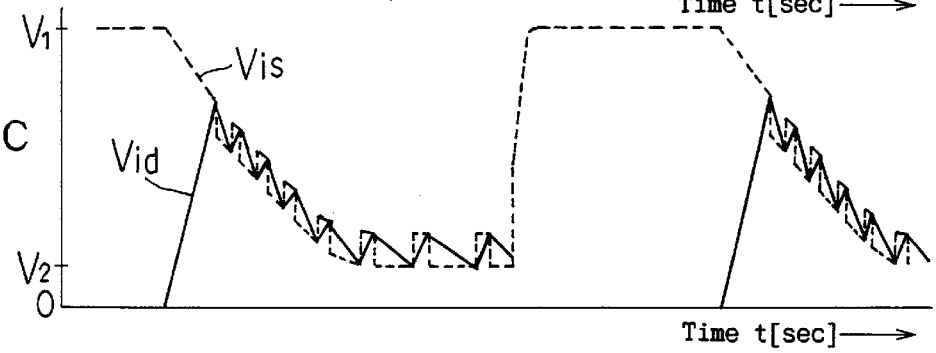
Figure 5D:
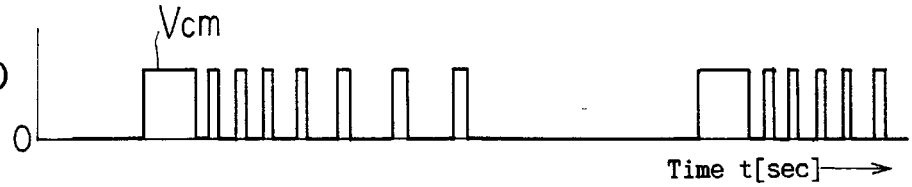

Control of the injector as described above permits the drive current Id to be rapidly increased as shown in (A) of FIG. 3 when the drive pulse Vd rising at time ta is generated as shown in (B) of FIG. 3, resulting in reaching the peak value Idp at time tb (>ta). The peak value Idp is set to be substantially high as compared with a level of the drive current at the time when the injection valve starts the port opening operation, so that the injection valve is moved to the port opening position before the drive current Id reaches the peak value Idp. Supposing that the drive pulse Vd is kept at a high level till time tg, the drive current Id is slowly decreased from time tb to the time tg, resulting in converging to the hold value Idh before the time tg.

Supposing the drive pulse Vd is rendered zero at the time tb at which the drive current Id reaches the peak to reduce the fuel injection quantity when the drive current Id exhibits such a waveform as shown in (A) of FIG. 3, the drive current Id is reduced along dashed lines a in (A) of FIG. 3, resulting in being rendered zero at time tbo (>tb). Then, the injection valve starts the port closing operation when a predetermined time lag ΔT elapses after the drive current is rendered zero at the time tbo.

Also, in FIG. 3, supposing that the drive pulse Vd is rendered zero at time tc (>tb) in the course of shift of the drive current from the peak value to the hold value, the drive current Id reduced along dashed lines c in (A) of FIG. 3, resulting in being rendered zero at time tco (>tbo) . The port closing operation of the injection valve is started when a predetermined time lag elapses from the time tco.

Likewise, when time at which the drive pulse Vd is rendered zero is delayed as indicated at td, te and tf, the drive current Id attenuates along dotted lines d, e and f in (A) of FIG. 3, to thereby be rendered zero at times tdo, teo and tfo (tfo>teo>tdo>tco>tbo), so that the injection valve starts the port closing operation at times delayed by a predetermined period of time from the times tdo, teo and tfo, respectively.

Thus, in the present invention, when the drive pulse is rendered zero in the course that the drive current is reduced from the peak value to the hold value; the more time at which the drive pulse is rendered zero is delayed or the more a pulse width of the drive pulse is increased, the more time at which the injection valve starts the port closing operation is delayed. Thus, the present invention permits the fuel injection quantity to be necessarily increased due to an increase in pulse width of the drive pulse. The control by the present invention permits relationship between the drive current Id and the pulse width τ of the drive pulse obtained near the part A in FIG. 8 to be as indicated at a curve b in FIG. 9, resulting in preventing an abnormal situation that a variation in the fuel injection quantity q fails to follow a variation in pulse width τ of the drive pulse. Therefore, the present invention permits the minimum fuel injection rate or fuel injection quantity available for the control to be reduced to increase the dynamic range qmax/qmin' of the injector.

The illustrated embodiment is so constructed that the transistor TR1 is used in an active region or as an amplifier to control the transistor by means of the control signal corresponding to a difference between-the indication signal Vis and the drive current detection signal Vid, to thereby permit a variation in the drive current ID to follow a variation in indication signal. Alternatively, the drive current Id may be subject to chopper control.

Figure 4:
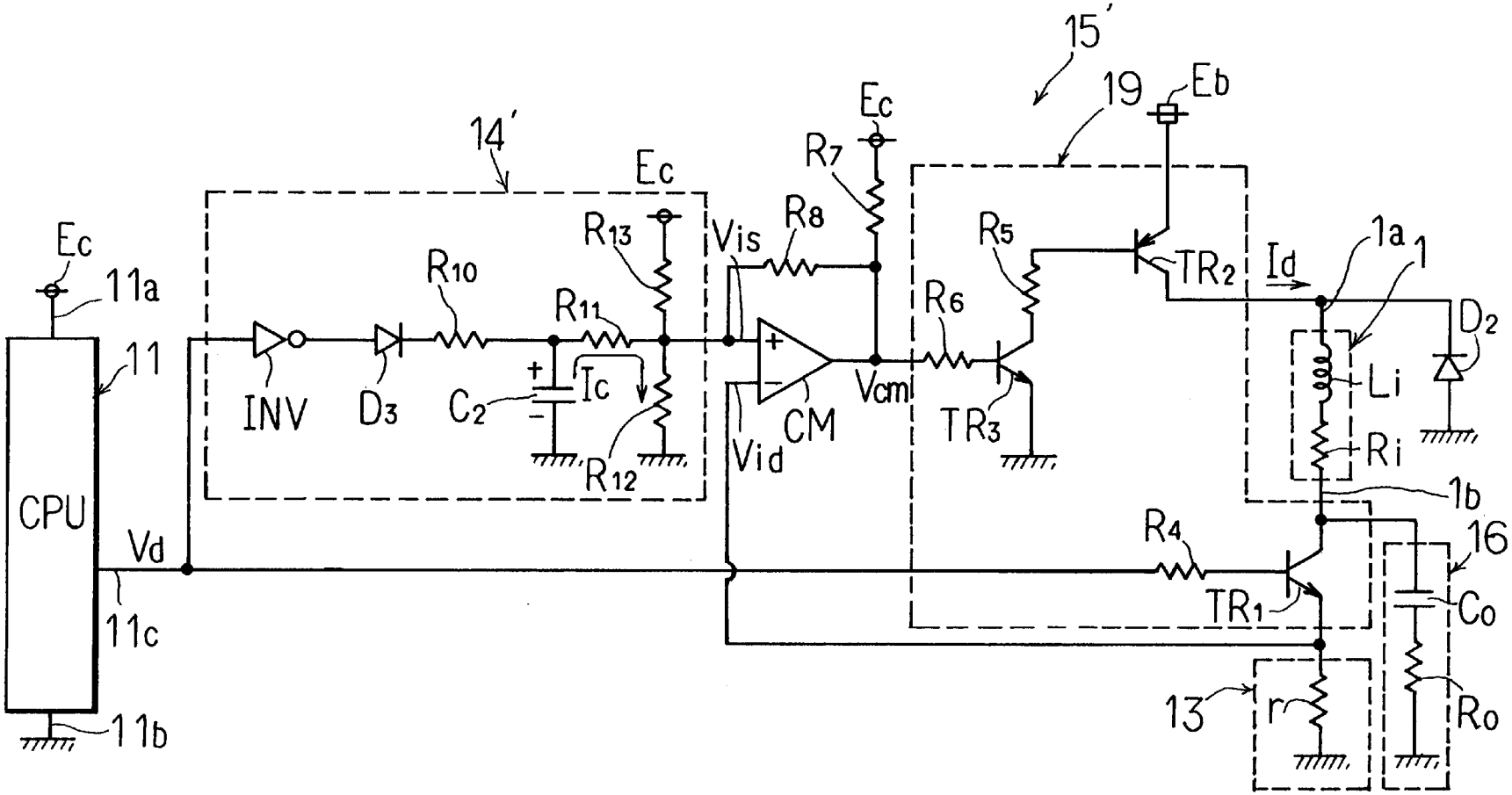
FIG. 4 is a circuit diagram showing another example of a drive control apparatus suitable for practice of a drive control method according to the present invention.

Referring now to FIG. 4, another embodiment of a drive control apparatus according to the present invention is illustrated, which is constructed so as to carry out chopper control of the drive current. In FIG. 4, reference numeral 1 designates an injector, 11 and 13 are a CPU and a drive current detection circuit which are constructed in the same manner as those shown in FIG. 1, respectively, 14' is an indication signal generation circuit, 15' is a current feed control circuit, and 19 is a drive voltage control switch circuit.

The injector 1 is connected at one input terminal 1*a* thereof to a collector of a PNP transistor TR2 and at the other input terminal 1*b* thereof to a collector of an NPN transistor TR1. In the illustrated embodiment, the transistors TR1 and TR2 each act as a switch element and a current detection resistor r is connected between an emitter of the transistor TR1 and the ground so as to provide the drive current detection circuit 13. The transistor TR1 has a base connected through a resistor R4 to a non-grounded output terminal of the CPU 11.

The transistor TR2 has an emitter connected to a DC power supply for generating a drive voltage Eb and a diode D2 is connected between the collector of the transistor TR2 and the ground while keeping an anode thereof facing the ground. The transistor TR2 has a base connected through a resistor R5 to a collector of an NPN transistor TR3 acting as a switch element for controlling on-off operation of the transistor TR2, as well as an emitter grounded. Also, the transistor TR3 has a base connected through a resistor R6 to an output terminal of a comparison circuit CM, which is connected through a resistor R7 to a positive-side output terminal of a control power circuit (not shown) for generating a control DC voltage Ec.

Also, the comparison circuit has an output terminal and a non-inversion input terminal (positive terminal), between which a feedback resistor R8 is connected. The comparison circuit CM is fed with an indication signal Vis and a drive current detection signal Vid through the non-inversion input terminal and a inversion input terminal (negative terminal) thereof, respectively. The comparison circuit CM functions to generate an output voltage Vcm of a high level when the indication signal Vis has a magnitude larger than the drive current detection signal Vid and that of a low level when the former has a magnitude smaller than the latter. A variation in output voltage Vcm of the comparison circuit CM is transmitted to the non-inversion input terminal of the comparison circuit through the feedback resistor R8, so that a level of the indication signal Vis is varied with a variation in output voltage Vcm of the comparison circuit CM, resulting in the comparison circuit CM having hysteresis characteristics.

In the illustrated embodiment, the transistors Tr1, TR2 and TR3 and the resistors R4, R5 and R6 cooperate with each other to constitute the drive voltage control switch circuit 19. The switch circuit 19 is arranged between a solenoid drive power supply (not shown) for applying the drive voltage Eb to a solenoid coil Li and the solenoid coil Li and functions to control the voltage applied to the solenoid coil Li so as to permit the drive voltage Eb to be applied to the solenoid coil Li when the output of the comparison circuit CM is kept at a high level while the drive pulse Vd is generated and remove the drive voltage Eb from the solenoid coil Li when the output of comparison circuit CM is kept at a low level while the drive pulse Vd is generated or when the drive pulse Vd is not generated.

Also, in the embodiment shown in FIG. 4, a circuit formed by connecting the injector 1, a collector-emitter circuit of the transistor TR1, the resistor R1, the diode D2 and the injector 1 to each other in turn constitutes an off-time drive current flow circuit which functions to flow the drive current to the solenoid coil Li of the injector 1 by means of a voltage induced across the solenoid coil Li when the switch circuit 19 is operated to separate the injector 1 from the power supply.

In the injector drive control apparatus shown in FIG. 4, the comparison circuit CM which is fed with the indication signal Vis and drive current detection signal Vid through the non-inversion input terminal and inversion input terminal thereof and which functions to generate the output voltage Vcm of a high level when the indication signal Vis has a magnitude larger than the drive current detection signal Vid and that of a low level when the former has a magnitude smaller than the latter, the feedback resistor R8 connected between the output terminal of the comparison circuit CM and the non-inversion input terminal thereof, the solenoid drive power supply (not shown) for generating the drive voltage Eb applied to the solenoid coil Li, the drive voltage control switch circuit 19 which is connected between the solenoid drive power supply and the solenoid coil Li and which functions to control the voltage applied to the solenoid coil Li in a manner to permit the drive voltage Eb to be applied to the solenoid coil Li when the output of the comparison circuit CM is kept at a high level while the drive pulse Vd is generated and remove the drive voltage Eb from the solenoid coil Li when the output of comparison circuit CM is kept at a low level while the drive pulse Vd is generated or when the drive pulse Vd is not generated, and the off-time drive current flow circuit for flowing the drive current to the solenoid coil by means of the voltage induced across the solenoid coil Li when the drive voltage control switch circuit 19 is turned off cooperate with each other to constitute the current feed control circuit 15'.

The indication signal generation circuit 14' is constituted by an inversion circuit INV having an input terminal connected to an output terminal 11*a* of the CPU 11 to invert the drive pulse Vd, a diode D3 of which an anode is connected to an output terminal of the inversion circuit INV, a charging resistor R10 connected at one end thereof to a cathode of the diode D3, a capacitor C2 charged to a first level when an output of the inversion circuit INV rises to a high level, a discharge circuit constituted by a first discharge resistor R11 connected at one end thereof to a non-grounded terminal of the capacitor C2 and a second discharge resistor R12 connected between the other end of the first discharge resistor R11 and the ground to discharge charges in the capacitor C2 through the resistors R11 and R12 at a fixed time constant, and a base voltage superposition resistor R13 connected between the other end of the first discharge resistor R11 and the positive-side output terminal of the control power circuit for generating the control DC voltage Ec and is so constructed that a signal having a waveform which gradually falls from a first level V1 when the drive pulse Vd is generated, to thereby converge to a second level V2 and then rises toward the first level V1 when the drive pulse is extinguished is generated in the form of the indication signal Vis across the resistor R12 constituting the discharge circuit.

In the injector drive control apparatus shown in FIG. 4, the output level of the inversion circuit INV is so set that the first level V1 of the indication signal Vis is rendered equal to a magnitude corresponding to the peak value of the drive current set to be higher than a level of the drive current Id at the time when the injection valve starts the port opening operation.

The time constant of the discharge circuit is so set that a time-based variation ratio of the indication signal Vis during reduction or shift of the indication signal Vis from the first level V1 toward the second level V2 is less than a time-based variation ratio of the drive current Id at the time when the voltage across the solenoid coil Li is stepwise decreased. Also, the second level V2 of the indication signal Vis is set to have a magnitude corresponding to the hold value of the drive current Id required to hold the injection valve at the port opening position.

In the injector drive control apparatus of FIG. 4, when the drive pulse Vd shown in (A) of FIG. 5 is not generated, the output voltage of the inversion circuit INV is kept at a high level, so that the capacitor C2 is charged through the resistor R10 by means of the output voltage of the inversion circuit INV. When the drive pulse Vd is generated, the output voltage of the inversion circuit INV is rendered zero, so that charges in the capacitor C2 are discharged at a fixed time constant through the resistors R11 and R12. When discharge of the capacitor C2 advances to render a voltage across the capacitor C2 equal to a base voltage V0 corresponding to a sum of a voltage drop across the discharge resistor R11 and a voltage obtained by subjecting the control power voltage Ec to voltage dividing by means of the resistors R13 and R12, the discharge is stopped. When the drive pulse Vd is extinguished, the output voltage of the inversion circuit INV is increased to a high level, resulting in the capacitor C2 being charged again. Thus, across the capacitor C2 is generated a voltage Vis' having a waveform kept at a high level when the drive pulse Vd is not generated and gradually reduced to converge to a predetermined level V0 when the drive pulse is generated, as shown in (B) of FIG. 5. A voltage corresponding to a value obtained by subtracting the voltage drop across the resistor R11 from the voltage Vis' across the capacitor C2 is obtained in the form of the indication signal Vis across the resistor R12. The indication signal Vis thus obtained is inputted to the non-inversion input terminal of the comparator CM.

As indicated at broken lines in (C) of FIG. 5, the indication signal Vis has a waveform varied with a variation in voltage Vis' across the capacitor C2, wherein the waveform gradually falls from the first level V1 to converge to the second level V2 when the drive pulse Vd is generated and then rises toward the first level V1 when the drive pulse is extinguished.

Also, in the illustrated embodiment, a variation in voltage at the output terminal of the comparator CM is transmitted through the feedback resistor R8 to the non-inversion input terminal of the comparator CM, so that the indication signal Vis is reduced every time when the level of the drive current detection signal Vid exceeds the level of the indication signal Vis, resulting in the output voltage Vcm of the comparator CM being reduced and is returned when the level of the drive current detection signal Vid is reduced below the level of the indication level Vis.

When the drive current flowing through the solenoid coil Li of the injector 1 is lower than an indication value and the drive current detection signal Vid (a curve indicated at a solid line in (C) of FIG. 5) has a level lower than that of the indication signal Vis (a curve indicated at broken lines in (C) of FIG. 5), the output voltage Vcm of the comparator circuit CM is kept at a high level as shown in (D) of FIG. 5, resulting in the transistor TR3 of the switch circuit 19 being turned on. This permits the transistor TR2 to be fed with a base current, resulting in being turned on. Also, the transistor TR1 is kept turned on while the CPU 11 generates the drive pulse Vd. This permits the drive current Id to flow through the emitter-collector circuit of the transistor TR2, the injector 1 and the collector-emitter circuit of the transistor TR1. When the drive current Id exceeds the indicated value provided by the indication signal Vis, the drive current detection signal Vid exceeds the indication signal Vis, so that the output voltage Vcm of the comparison circuit CM is shifted to a low level, resulting in the transistors TR3 and TR2 being turned off. At this time, the drive current flowing through the solenoid coil Li of the injector 1 is caused to flow through the collector-emitter circuit of the transistor TR1 and the diode D2, leading to gradual attenuation. Also, shifting of the output voltage of the comparison circuit CM to a low level causes the feedback resistor R8 to reduce a level of the indication signal Vis, so that the drive current detection signal Vid is kept higher than the indication signal Vis for a predetermined period of time, resulting in the transistors TR3 and TR2 being kept turned off for a while. When the drive current Id is reduced below the indicated value provided by the indication signal Vis, the output voltage Vcm of the comparison circuit CM is shifted to a high level, so that the transistors TR3 and TR2 are turned on, to thereby permit the drive current Id to flow through the solenoid coil Li again. Repeating of such operation permits the drive current Id to be controlled so as to be rendered equal to the indicated value provided by the indication signal Vis.

The embodiment of FIG. 4, as discussed above, controls the drive current in the manner that repeating of on-off operation of the transistor TR2 renders the drive current equal to the indicated value while carrying out intermittent flowing of the drive current. This minimizes an internal loss of the switch elements (transistors TR1 and TR2) for controlling the drive current, to thereby restrain generation of heat from the switch elements.

Also, the embodiment of FIG. 4 permits an on-duty ratio of the transistor TR2 to be varied by means of a resistance value of the feedback resistor R8, wherein an increase in resistance value of the feedback resistor R8 to reduce the amount of feedback thereof increases the on-duty ratio of the transistor TR2, so that the apparatus of FIG. 4 may carry out operation like that of the apparatus shown in FIG. 1. Further, when the feedback resistor R8 is reduced in resistance value to increase the amount of feedback, the on-duty ratio of the transistor TR2 is decreased to cause the content of a pulsating component in the drive current to be increased, to thereby fail to smoothly control the drive current. Thus, the resistance value of the feedback resistor R8 is set at a value sufficient to ensure that the content of pulsating component in the drive current Id is limited to a range which does not interfere with operation of the injector and an internal loss of the transistors TR2 and TR1 is minimized.

In the embodiments described above, the drive current is increased to the peak value and then immediately reduced toward the hold value as shown in (A) of FIG. 3. Alternatively, the present invention may be so constructed that the drive current is kept at the peak value for a predetermined period of time and then reduced toward the hold value at a time-based variation ratio less than a time-based variation ratio of the drive current at the time when a voltage across the solenoid coil is stepwise reduced.

As can be seen from the foregoing, the present invention is constructed so as to carry out control of the drive current in the manner that a time-based variation ratio of the drive current during reduction of the drive current from the peak value to the hold value is less than a time-based variation ratio of the drive current at the time when a voltage across the solenoid coil is stepwise decreased. Such construction permits the fuel injection rate to be increased with an increase in pulse width of the drive pulse even when the drive pulse is rendered zero during shifting of the drive current from the peak value to the hold value. This results in reducing the minimum fuel injection quantity available for control of the injector, to thereby increase a dynamic range of the injector, leading to an improvement in control of the fuel injection quantity.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise as specifically described.

What is claimed is:

1. A method for controlling drive of an injector for an internal combustion engine wherein the injector including an injection valve for selectively closing a fuel injection port and a solenoid coil fed with a drive current when the injection valve opens the fuel injection port is controlled in response to a drive pulse for commanding injection of fuel, comprising the steps of:

stepwise increasing a voltage across the solenoid coil to increase the drive current flowing through the solenoid coil to a peak value set to be higher than a level of the drive current at which the injection valve starts port opening operation when the drive pulse is generated and gradually reducing the drive current toward a hold value required to hold the injection valve at a port opening position at a time-based variation ratio thereof less than a time-based variation ratio of the drive current at the time when the voltage across the solenoid coil is stepwise reduced from the peak value; and stepwise reducing the voltage across the solenoid coil to extinguish the drive current when the drive pulse is extinguished.

2. An apparatus for controlling drive of an injector for an internal combustion engine wherein the injector includes an injection valve for selectively closing a fuel injection port and a solenoid coil fed with a drive current when the injection valve opens the fuel injection port, comprising:

a drive current detection circuit for detecting said drive current of the injector to generate a drive current detection signal;

an indication signal generation circuit for generating an indication signal providing an indicated value for said drive current; and a current feed control circuit for controlling current feed to the solenoid coil so as to permit a drive current corresponding in magnitude to said indication signal to flow through the solenoid coil during a period of time for which a drive pulse for commanding fuel injection is generated while using said drive current detection signal and indication signal as an input therefor;

said indication signal generation circuit being so constructed that a signal having a waveform which rises to a first level when said drive pulse is generated and then gradually falls at a time-based variation rate less than a time-based variation time of said drive current at the time when a voltage across said solenoid coil is stepwise reduced, to thereby ultimately converge to a second level is generated as said indication signal;

said first level of said indication signal being set so as to have a magnitude corresponding to a peak value of the drive current which is set to be higher than a level of the drive current at the time when the injection valve starts port opening operation;

said second level of said indication signal being set at a magnitude corresponding to a hold value of the drive current required to hold the injection valve at a port opening position.

3. An apparatus for controlling drive of an injector for an internal combustion engine wherein the injector includes an injection valve for selectively closing a fuel injection port and a solenoid coil fed with a drive current when the injection valve opens the fuel injection port, comprising:

a drive current detection circuit for detecting said drive current of the injector to generate a drive current detection signal;

an indication signal generation circuit for generating an indication signal providing an indicated value for said drive current; and a current feed control circuit for controlling current feed to the solenoid coil so as to permit a drive current corresponding in magnitude to said indication signal to flow through the solenoid coil during a period of time for which a drive pulse for commanding fuel injection is generated while using said drive current detection signal and indication signal as an input therefor;

said indication signal generation circuit including a differentiation circuit for differentiating rising of said drive pulse and a base voltage superposition circuit for superposing a base voltage of a predetermined level on an output of said differentiation circuit and being so constructed that a signal having a waveform which substantially instantaneously rises to a first level when said drive pulse is generated and then gradually falls, to thereby converge to a second level is generated as said indication signal;

said drive pulse having a level set so as to render said first level of said indication signal equal to a magnitude corresponding to a peak value of the drive current which is set to be higher than a level of the drive current at the time when the injection valve starts port opening operation;

said differentiation circuit having a constant set so that a time-based variation ratio thereof at the time when said indication signal falls from said first level to said second level is less than a time-based variation ratio of said drive current at the time when a voltage across the solenoid coil is stepwise reduced;

said base voltage having a magnitude set so that said second level of said indication signal has a magnitude corresponding to a hold value of the drive current required to hold the injection valve at a port opening position.

4. An apparatus for controlling drive of an injector for an internal combustion engine wherein the injector includes an injection valve for selectively closing a fuel injection port and a solenoid coil fed with a drive current when the injection valve opens the fuel injection port, comprising:

a drive pulse generation means for generating a drive pulse for commanding fuel injection;

a drive current detection circuit for detecting said drive current for the injector to generate a drive current detection signal;

an indication signal generation circuit for generating an indication signal providing an indicated value for said drive current; and a current feed control circuit for controlling current feed to the solenoid coil so as to permit a drive current corresponding in magnitude to said indication signal to flow through the solenoid coil during a period of time for which said drive pulse is generated while using said drive current detection signal and indication signal as an input therefor;

said drive pulse generation means including a power terminal connected to a positive-side output terminal of a power circuit of which a negative-side output terminal is grounded, a grounded output terminal and a non-grounded output terminal and being so constructed that said non-grounded terminal has a potential increased to a high level when the drive pulse is generated and is kept at a ground potential when the drive pulse is not generated;

said indication signal generation circuit including a differentiation circuit which includes a differentiation capacitor having one end connected to said non-grounded output terminal of said drive pulse generation means, a first resistor having one end connected to the other end of said differentiation capacitor and a second resistor connected between said first resistor and the ground and generates a differentiation pulse across a series circuit of said first resistor and second resistor, and a third resistor which is connected between said positive-side output terminal of said power circuit and one end of said second resistor and being constructed so as to generate, across said second resistor, a signal having a waveform which substantially instantaneously rises to a first level when said drive pulse is generated and then gradually falls, to thereby converge to a second level as said indication signal;

said drive pulse having a level set so as to render said first level of said indication signal equal to a magnitude corresponding to a peak value of the drive current which is set to be higher than a level of the drive current at the time when the injection valve starts port opening operation;

said differentiation circuit having a constant set so that a time-based variation ratio of said indication signal at the time which said indication signal falls from said first level toward said second level is less than a time-based variation ratio of said drive current at the time when a voltage across the solenoid coil is stepwise reduced;

said second and third resistors each having a resistance value set so that said second level of said indication signal has a magnitude corresponding to a hold value of the drive current required to hold the injection valve at a port opening position.

5. An apparatus as defined in claim 4, wherein said current feed control circuit includes an operational amplifier having a non-inverting input terminal and an inverting input terminal to which said indication signal and drive current detection signal are respectively inputted, a drive current feed amplifier for feeding said solenoid coil with the drive current proportional to a control signal comprising a signal generated from said operational amplifier, and a feedback diode of which a cathode is connected between a control signal input terminal of said drive current feed amplifier and said non-grounded output terminal of said drive pulse generation means while facing said non-grounded output terminal to hold said control signal at a low level below an input threshold level of said drive current feed amplifier when said drive pulse is not generated.

6. An apparatus for controlling drive of an injector for an internal combustion engine wherein the injector includes an injection valve for selectively closing a fuel injection port and a solenoid coil fed with a drive current when the injection valve opens the fuel injection port, comprising:

a drive current detection circuit for detecting said drive current of the injector to generate a drive current detection signal;

an indication signal generation circuit for generating an indication signal providing an indicated value for said drive current; and a current feed control circuit for controlling current feed to the solenoid coil so as to permit a drive current corresponding in magnitude to said indication signal to flow through the solenoid coil during a period of time for which a drive pulse for commanding fuel injection is generated while using said drive current detection signal and indication signal as an input therefor;

said indication signal generation circuit including an inversion circuit for inverting said drive pulse, a capacitor charged to a first level when an output of said inversion circuit rises to a high level and a discharge circuit for discharging charges in said capacitor through a resistor at a fixed time constant and being so constructed that a signal having a waveform which gradually falls from a first level when said drive pulse is generated, to thereby converge to a second level and then rises toward said first level when said drive pulse is extinguished is generated in the form of said indication signal across the resistor of said discharge circuit;

said current feed control circuit including a comparison circuit having a non-inversion input terminal and an inversion input terminal to which said indication signal and drive current detection signal are respectively input, to thereby generate an output of a high level when said indication signal is larger than said drive current detection signal and an output of a low level when said indication signal is smaller than said drive current detection signal, a feedback resistor connected between an output terminal of said comparison circuit and said non-inversion input terminal thereof, a drive voltage control switch circuit arranged between the solenoid coil and a solenoid drive power supply for generating a drive voltage applied to the solenoid coil to apply the drive voltage to the solenoid coil when the output of said comparison circuit is at a high level while said drive pulse is generated and control the drive voltage applied to the solenoid coil so as to remove the drive voltage from the solenoid coil when the output of said comparison circuit is at a low level while said drive pulse is generated or when said drive pulse is not generated, and an off-time drive current flow circuit for flowing the drive current through the solenoid coil by means of a voltage induced across the solenoid coil when said drive voltage control switch circuit is rendered off;

said inversion circuit having an output level set so as to render said first level of said indication signal equal to a magnitude corresponding to a peak value of the drive current set to be higher than a level of the drive current at the time when the injection valve starts port opening operation;

said discharge circuit having a time constant set so that a time-based variation ratio of said indication signal at the time which said indication signal falls from said first level toward said second level is less than a time-based variation ratio of said drive current at the time when a voltage across the solenoid coil is stepwise reduced;

said second level of said indication signal being set at a magnitude corresponding to a hold value of the drive current required to hold the injection valve at a port opening position.

* * * * *

UNITED STATES PATENT AND TRADEMARK OFFICE

CERTIFICATE OF CORRECTION

PATENT NO. : 5,941,216
DATED : August 24, 1999
INVENTOR(S) : Arakawa

It is certified that error appears in the above-identified patent and that said Letters Patent is hereby corrected as shown below:

Column 6, Line 4, delete "nozzles" and insert --nozzle 3--.

Column 7, Line 54, delete "injection-valve" and insert --injection valve--.

Signed and Sealed this
First Day of February, 2000

*Attest:*

Q. TODD DICKINSON

*Attesting Officer*

*Acting Commissioner of Patents and Trademarks*